US006782824B2

(12) United States Patent
Schneider

(10) Patent No.: US 6,782,824 B2
(45) Date of Patent: Aug. 31, 2004

(54) PRINTING UNIT WITH REVERSIBLE IMAGE SETTING AND DIGITAL CHANGEOVER

(75) Inventor: Josef Schneider, Diedorf (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 24 days.

(21) Appl. No.: 10/138,237

(22) Filed: May 2, 2002

(65) Prior Publication Data

US 2002/0174784 A1 Nov. 28, 2002

(30) Foreign Application Priority Data

May 4, 2001 (DE) ..... 101 21 827

(51) Int. Cl.[7] ..... B41C 1/10; B41F 7/12

(52) U.S. Cl. ..... 101/467; 101/462; 101/478

(58) Field of Search ..... 101/136, 141, 101/174, 376, 453, 454, 457, 458, 459, 460, 462, 463.1, 465, 467, 478

(56) References Cited

U.S. PATENT DOCUMENTS

| | | | | | |
|---|---|---|---|---|---|
| 3,741,118 | A | * | 6/1973 | Carley | 101/451 |
| 4,341,156 | A | * | 7/1982 | Kaeppner | 101/141 |
| 4,481,282 | A | * | 11/1984 | Obata et al. | 430/303 |
| 4,538,516 | A | * | 9/1985 | Aaron | 101/219 |
| 4,718,340 | A | * | 1/1988 | Love, III | 101/116 |
| 4,903,599 | A | * | 2/1990 | Kubler et al. | 101/450.1 |
| 5,595,115 | A | * | 1/1997 | Rau et al. | 101/142 |
| 5,601,022 | A | | 2/1997 | Dauer et al. | 101/467 |
| 5,704,288 | A | * | 1/1998 | John | 101/216 |
| 6,070,528 | A | | 6/2000 | Fleischmann et al. | 101/170 |
| 6,101,944 | A | | 8/2000 | Schmid et al. | 101/467 |
| 6,477,955 | B1 | * | 11/2002 | Landsman | 101/457 |

FOREIGN PATENT DOCUMENTS

| | | |
|---|---|---|
| DE | 195 30 283 | 10/1996 |
| DE | 195 23 378 | 1/1997 |
| DE | 199 39 240 | 3/2001 |
| EP | 0 368 180 | 5/1993 |

* cited by examiner

*Primary Examiner*—Stephen R. Funk
(74) *Attorney, Agent, or Firm*—Cohen, Pontani, Lieberman & Pavane

(57) ABSTRACT

A printing unit for a rotary printing machine with reversible image setting and digital changeover by means of thermal transfer, having an image-setting unit, an erasing or cleaning component and at least one inking unit. In order to achieve further cost advantages and miniaturization for such a printing unit, in particular for use in small edition color printing (digital offset press), the form cylinder and blanket cylinder are combined into one cylinder. In order to produce the reversible setting of an image (form production), this cylinder is provided with a hydrophilic surface and interacts directly with an impression cylinder in order to print on a substrate. The image-setting unit and erasing or cleaning component and inking unit are set against this cylinder.

5 Claims, 1 Drawing Sheet

PRINTING UNIT WITH REVERSIBLE IMAGE SETTING AND DIGITAL CHANGEOVER

BACKGROUND OF THE INVENTION

1. Field of the Invention

The invention relates to a printing unit with reversible image setting and digital changeover by means of thermal transfer, including an image setting unit, an erasing or cleaning component, and at least one inking unit.

2. Description of the Related Art

As is known, the printing unit, in particular of a sheet-fed offset printing machine, generally comprises the forme cylinder, the blanket cylinder and the impression cylinder which presses the printing material against the blanket cylinder to transfer the printing inks and, for example for digital multicolor printing, one or more inking units. It is also known that the printing form or the forme cylinder can be provided in the printing machine with a thermal transfer film with thermal transfer material corresponding to an image. The transfer of the transfer material is preferably performed by laser induction, but other energy sources such as heating elements, heating lines, heating matrices or the like would also be conceivable. The surface of the forme cylinder is then inked with printing ink, in particular for an offset process and, as is known, the printing ink from the ink-carrying areas is transferred via the blanket cylinder onto the substrate or paper sheet to be printed. Known coverings for blanket cylinders for offset printing are, in particular, polyurethane materials, which are distinguished by a homogeneous surface, good dimensional stability and optimum ink and damping solution transport.

For a quick change of the printing motifs, in particular for small editions, the aim is to carry out the procedure within the printing machine, firstly under computer control and secondly without changing moving parts.

By means of an image-setting unit, the image information in the form of ink-accepting area elements on the lipophobic surface of the printing form or of the printing forme cylinder is transferred within the printing machine.

The thermal transfer film is provided with a thermally or electrothermally sensitive coating with oleophilic, that is to say ink-accepting properties. The image setting unit comprises a print head, which can be a row of heating elements, an electrode, an energy beam or any other unit that produces heat, in particular a laser print head. To transfer an item of image information, the print head is controlled via the appropriate image signals in such a way that it introduces heat and pressure into the thermal transfer film at each image point and therefore has the effect of transferring the coating of the film point by point to the surface of the forme cylinder. The forme cylinder rotates in the process, and the print head is traversed appropriately, so that the surface on the forme cylinder can have an image set on it from the thermal transfer film, for example in a spiral shape.

As is known, e.g. from U.S. Pat. No. 5,601,022, for the repeated coating of the forme cylinder surface in accordance with an image, subassemblies are arranged within the printing machine. These subassemblies include a feed device for a thermal transfer film to the forme cylinder, a laser print head that can be coordinated with the rotational movement of the forme cylinder, and an electronically controlled image-point transfer unit for activating the laser print head and an erasing or cleaning component which can remove the coating in accordance with the image from the surface of the forme cylinder again. As disclosed in U.S. Pat. No. 6,070,528, the element for removing the coating in accordance with an image or the thermal transfer material from the surface of the printing form may be a high-pressure cleaner, or else a blanket washing system, or cleaning by ultrasound or the like.

The strip-like thermal transfer film used in U.S. Pat. No. 5,601,022 can have a comparatively thin coating with thermal transfer material, so that the image-setting layer thickness on the forme cylinder can be thin and this coating in accordance with an image can also be removed again easily, that is to say the forme cylinder can be erased again or changed over more easily or more quickly, in accordance with the reduction in the layer thickness of the thermal transfer material.

Hitherto, in the case of printing units of the type previously described in use in small edition color printing (digital offset press), that is to say with printing forms which are coated in accordance with the thermal transfer process, use is made of forme cylinders with a metallic surface made, for example, of aluminum, of steel or steel alloys, of chromium or a metal oxide, since such surfaces are distinguished by good impression constancy. In order to print on the substrate or on the sheet in a small sheet machine, hitherto a blanket cylinder with a soft surface has been interposed and the substrate or the sheet has been led through between the blanket cylinder and an impression cylinder. Both the blanket cylinder and the impression cylinder are generally covered with a rubber blanket.

EP 0 368 180 B1 discloses a three-cylinder printing unit for an offset printing machine, in which the blanket cylinder is used as a transfer cylinder for a printing image produced by the surface of a forme cylinder by means of a thermal transfer process. The forme cylinder has an elastomeric surface with preferably hydrophilic property, the elastomeric surface of the forme cylinder being necessitated by the fact that fluctuations in linearity along the recording line can effectively be compensated for by its compressibility.

SUMMARY OF THE INVENTION

On the basis of the printing unit or machine configuration described above, it is the object of the invention to achieve further cost advantages and miniaturization effects for such a printing unit, in particular for use in small edition color printing (digital offset press).

The fact that the forme cylinder and blanket cylinder are combined into one cylinder in a printing unit of the generic type, in such a way that, in order to produce the reversible setting of an image (form production), this cylinder interacts directly with an impression cylinder in order to print on a substrate, and that image-setting unit and erasing and cleaning component and inking unit are set against this cylinder, so that this cylinder has the function of a forme cylinder, it is possible, for example, for the previous forme cylinder to be omitted (dilitho) and for the previous blanket cylinder to assume the function of the previous forme cylinder as well.

This means, in particular, as a particular cost advantage, the saving of a cylinder involved directly in the printing in a printing unit described at the beginning. Furthermore, the printing unit according to the invention provides a contribution to miniaturization with the objective of a "PICO-FORMAT" very small printing machine. In this way, the changeover costs are made cheaper and the required floor area is reduced.

A particularly preferred exemplary embodiment includes the fact that in order to produce the reversible setting of an image (form production), this cylinder is designed with a surface made of a hydrophilic elastomer, that is to say a polymeric material with a high elasticity, and the impression cylinder is designed with a comparatively hard surface made of rubber, but can also be made of steel.

A further advantageous embodiment is for the cylinder, which has both the function of a blanket cylinder and that of a forme cylinder, to be designed as a blanket cylinder with a conventional surface, that is to say with an incompressible (conventional) rubber blanket cover or even with a hard steel surface (erasable sleeve) and for the impression cylinder to be provided with a comparatively soft surface, in particular one made of a hard resilient rubber.

The fact that at least the hydrophilic surface of the cylinder accepting the printing image is designed without a seam, or preferably all the cylinder surfaces involved directly in the printing are designed without a seam means that very quiet running of the printing unit is ensured, since resonance phenomena arising from clamping channels or plate winding devices are ruled out.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
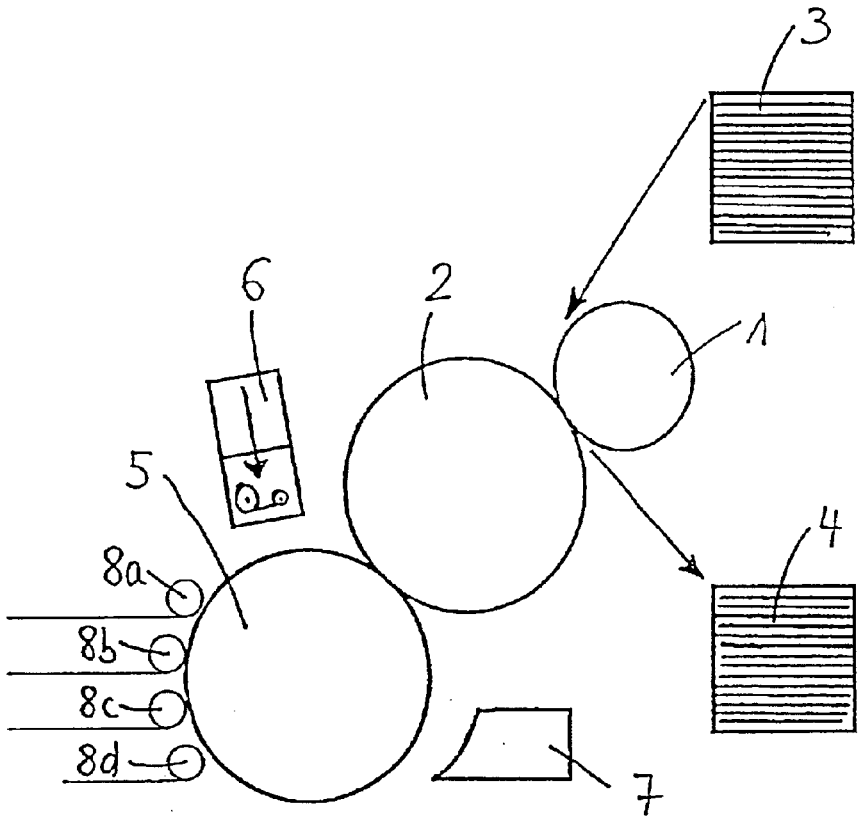
Fig. 1 (PRIOR ART)
FIG. 1 shows a typical three-cylinder printing unit for a small-sheet machine for digital multicolor printing.

FIG. 1 shows a three-cylinder printing unit for a sheet-fed offset printing machine in schematic form. A substrate, here a sheet from the sheet feeder 3, is led through between an impression cylinder 1 and blanket cylinder 2 during the printing operation, and is conveyed to the sheet delivery 4. The blanket cylinder 2 serves as a transfer cylinder for a printing image produced by the surface of a forme cylinder 5. The forme cylinder 5 has an erasable metallic surface. In order to produce the printing image on the surface of the forme cylinder 5, an image-setting unit 6, comprising a laser and a thermal transfer ribbon, are provided.

In a known manner, in order to produce a printing forme for planographic printing, ink-accepting area elements can consequently be transferred from the thermal transfer ribbon, under the action of heat and pressure, to the hydrophilic metallic surface of the forme cylinder (printing-form production by laser ablation).

As is known, the thermal transfer ribbon is preferably located in an easily replaceable cassette housing (in this context, see for example U.S. Pat. No. 6,304,281).

For the purpose of digital changeover, an erasing or cleaning component 7 is also assigned to the forme cylinder 5, downstream of the image-setting unit 6 in the running direction, which removes the area elements and therefore the printing image on the erasable metallic surface of the forme cylinder 5 again and can provide the surface for renewed image-setting in the printing unit. Downstream of the image-setting unit 6 and erasing or cleaning component 7, in the circumferential direction, four short inking units 8*a, b, c, d* are set against the forme cylinder 5, so that discontinuous, segment-by-segment inking of the printing form previously created is possible.

Figure 2:
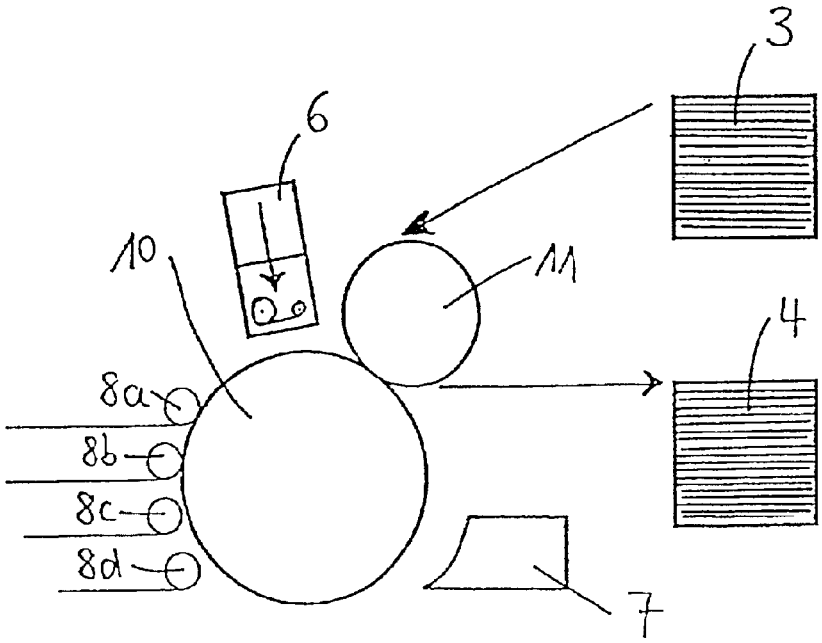
FIG. 2 shows a printing unit designed in accordance with the invention, likewise used as a small sheet machine in digital multicolor printing.

Developing such a printing unit, a similar printing unit for digital multicolor printing in the form of a small sheet machine with thermal transfer (preferably in the A3 format) is shown as an embodiment in FIG. 2, in which, however, the forme and blanket cylinders have been combined into one cylinder 10 which, in an analogous way to the blanket cylinder 2 from FIG. 1, interacts directly with an impression cylinder 11 in order to print on a sheet.

However, the cylinder 10 preferably has an erasable, elastomeric surface with a hydrophilic characteristic (for example is a conventional forme or blanket cylinder coated with a hydrophilic elastomer). Suitable materials for such a surface are, for example, acrylic esters, rubber, nitrile rubber or modified polyvinyl chloride (PVC). The hydrophilic elastomeric surface is composed in such a way that the application of damping solution can be ensured. The transfer and application of printing ink is performed by the image elements applied by means of thermal transfer.

However, the cylinder 10 can also have a conventional incompressible rubber blanket surface or even a hard surface made of steel or a steel alloy, which likewise permits the application of damping solution and applies the ink by means of the thermal transfer image elements. However, the impression cylinder 11 is then provided with a comparatively soft surface, in particular one made of a hard resilient rubber.

Analogously to FIG. 1, this cylinder 10 is assigned an image-setting unit 6, an erasing or cleaning component 7 and four short-form inking units 8*a* to *d*. The image-setting unit 6 therefore interacts directly with an erasable elastomeric surface with hydrophilic properties.

By using the printing unit according to the invention, in turn a highly-automated printing machine with digital form production in the machine can be built up, in particular for small edition color printing.

Further advantages are provided by the intermittent short-form inking units 8*a* to *d* associated with the cylinder 10 with hydrophilic surface in that a complete application of ink is possible during four revolutions of the cylinder 10, only one image-setting unit 6 being needed for all the color separations and continuing to keep the investment costs low and additionally improving the miniaturization effect.

In addition, the color flexibility is improved, since 1-color, 2-color or 4-color printing always remains equally productive.

Furthermore, in the embodiment of the sheet-fed machine, a turning option can be provided by means of a new feed for the stack 4 (lift) and a single-gripper closure can be implemented with minimum register problems.

The fact that drive motors can be accommodated both in the cylinder 10 that accepts the printing image and in the impression cylinder 11 means that even an application of the printing unit for copying machines in the copy shop is conceivable.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A printing unit for a rotary printing machine with reversible image setting and digital changeover by means of thermal transfer, said printing unit comprising an impression cylinder, a reversibly imagable cylinder having a hydrophilic elastomeric surface on which an image can be set and erased, said reversibly imageable cylinder interacting with said impression cylinder in order to print on a substrate passing therebetween, said impression cylinder having a surface which is harder and has a higher elasticity than said hydrophilic elastomeric surface, a thermal transfer image setting unit which can be set against said reversibly imagable cylinder, an erasing and cleaning component which can be set against said reversibly imagable cylinder, and at least one inking unit which can be set against said reversibly imagable cylinder.

2. A printing unit as in claim 1 wherein said reversibly imagable cylinder has a seamless hydrophilic surface.

3. A printing unit as in claim 2 wherein said impression cylinder has a surface which is seamless.

4. A printing unit as in claim 1 comprising a plurality of short inking units which can be set against said reversibly imagable cylinder.

5. A printing unit as in claim 1 wherein said thermal transfer image-setting unit comprises a laser or and a thermal transfer ribbon.

* * * * *